US006315520B1

(12) United States Patent
Haje et al.

(10) Patent No.: US 6,315,520 B1
(45) Date of Patent: Nov. 13, 2001

(54) TURBINE CASING AND METHOD OF MANUFACTURING A TURBINE CASING

(75) Inventors: Detlef Haje, Bottrop; Andreas Feldmüller, Bochum, both of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/564,899

(22) Filed: May 3, 2000

Related U.S. Application Data

(63) Continuation of application No. PCT/DE98/03122, filed on Oct. 21, 1998.

(30) Foreign Application Priority Data

Nov. 3, 1997 (DE) ..... 197 48 540
Apr. 30, 1998 (DE) ..... 198 19 508

(51) Int. Cl.[7] ..... F01D 25/08
(52) U.S. Cl. ..... 415/178
(58) Field of Search ..... 415/178, 108, 415/115, 116, 117, 176, 200; 29/889.2, 888.01; 164/361, 464, 465, 122.1, 47, 367

(56) References Cited

U.S. PATENT DOCUMENTS 3,949,552 4/1976 Kaneko et al. .
4,762,462 8/1988 Lardellier .
5,662,457 * 9/1997 Bechtel et al. ..... 415/135
6,213,710 * 4/2001 Remberg ..... 415/108

FOREIGN PATENT DOCUMENTS 381 367 10/1986 (AT) .
564 761 11/1932 (DE) .
37 12 830 A1 11/1988 (DE) .
195 35 227 A1 3/1997 (DE) .
0 374 603 6/1990 (EP) .
1178609 1/1970 (GB) .

* cited by examiner

*Primary Examiner*—F. Daniel Lopez
*Assistant Examiner*—James M McAleenan
(74) *Attorney, Agent, or Firm*—Herbert L. Lerner; Laurence A. Greenberg; Werner H. Stemer

(57) ABSTRACT

A turbine casing includes a multilayer casing wall in which an intermediate layer in the form of a non-metallic bulk material, preferably sand, is provided between an inner layer and an outer layer, to cope with high steam states. A method of manufacturing a multilayer turbine casing includes inserting a core representing an intermediate layer into a casting mold while forming a cavity for the inner layer and/or the outer layer. The cavity is then filled with a casting material, with the core expediently remaining as the intermediate layer in the casing wall. Alternatively, first of all a U-shaped profile part is made and an intermediate space formed by the outer layer and the inner layer is filled with the bulk material.

25 Claims, 5 Drawing Sheets

TURBINE CASING AND METHOD OF MANUFACTURING A TURBINE CASING

CROSS-REFERENCE TO RELATED APPLICATION

This application is a continuation of copending International Application No. PCT/DE98/03122, filed Oct. 21, 1998, which designated the United States.

BACKGROUND OF THE INVENTION

FIELD OF THE INVENTION

The invention relates to a turbine casing having a multilayer casing wall with a pressure-tight, heat-insulating intermediate layer between an inner layer sealing off a pressure space and a force-transmitting outer layer. The invention also relates to a method of manufacturing such a casing. The term turbine casing refers in particular to the outer casing of a high-pressure steam turbine.

In a turbine working as a prime mover, potential energy of a flowing working medium such as, for example, gas or steam, is converted into mechanical work. To that end, the turbine includes a rotor wheel and a fixed guide wheel as essential elements. Thus, steam serving as a flow medium in a steam turbine is expanded until it condenses to perform work. In that case, the structure of the steam turbine is determined in particular by steam states, i.e. steam pressure and steam temperature.

Especially high steam states are aimed at due to the desire for an efficiency of a steam turbine which is as high as possible. In a high-pressure turbine, an increase in the live-steam pressure, e.g. to 300 bar, and in the live-steam temperature, e.g. to 600° C., requires a material selection corresponding to the temperature effect and a turbine-casing wall thickness corresponding to the stress due to the internal pressure prevailing at high temperature. In that case, it should be taken into account that the admissible stresses markedly decrease with increasing component temperature. A correspondingly larger wall thickness would therefore be necessary to absorb the pressure forces with the turbine casing.

The casing parts that are required for high steam states and are made of temperature-resistant materials having a large wall thickness result in considerable material costs, in view of the high costs for such materials. However, ease of manufacture is also an aspect which proves to be an obstacle to an increase in the wall thickness, in particular the castability of the alloys at the requisite wall thicknesses. Further aspects to be taken into account are the operating behavior of the turbine with regard to the start-up and shutdown times influenced by the heating-up and cooling-down behavior of the casing parts and the handling due to the mass, which increases with the wall thickness. It should also be taken into account that, in the turbine casing, not only does the wall thickness increase with increasing pressure, but the strength of the conventional materials also decreases with increasing temperature.

In order to provide the heat insulation of an outer casing of a high-pressure turbine, it is known from German Published, Non-Prosecuted Patent Application DE 195 35 227 A1 to place an insulating layer or course on the inside of the outer casing, and to provide the inside of the insulating layer with a lining. In that casing wall having a multilayer construction, a castable ceramic or a castable lightweight refractory concrete is provided as an insulating layer. However, a disadvantage of that construction is that the hardened insulating layer tends to fracture as a result of operationally induced thermal stresses. That may lead in an undesirable manner to the formation of cracks in the adjacent layers, in particular in the outer layer.

Furthermore, it is known from Austrian Patent 381 367 B to provide a metallic insulating body, in particular in the form of metal fibers, in the steam space of a steam turbine. Since the insulating body provided in the steam space comes into direct contact with the steam serving as an insulating medium, on one hand the metal parts must be sufficiently large in order not to be entrained by the steam flow, which would lead to the destruction of the turbine. On the other hand, a sufficiently loose bulk fill of the metal parts is required so that the steam can flow at least more or less unimpeded through the insulating body. Sufficient heat insulation and pressure tightness is not achieved with such a metallic insulating body.

SUMMARY OF THE INVENTION

It is accordingly an object of the invention to provide a multilayer turbine casing for a high-pressure turbine and an especially suitable method of manufacturing a multi-walled turbine casing for a high-pressure turbine, which overcome the hereinafore-mentioned disadvantages of the heretofore-known devices and methods of this general type and in which the turbine casing enables high steam states, i.e. a high pressure and a high temperature of a flow medium, to be realized, through the use of an especially suitable, pressure-tight, heat-insulating intermediate layer.

With the foregoing and other objects in view there is provided, in accordance with the invention, a turbine casing, in particular an outer casing of a high-pressure turbine, defining a pressure space, comprising a multilayer or three-layer casing wall having an inner layer sealing off the pressure space, a force-transmitting outer layer, and a pressure-tight, heat-insulating intermediate layer formed of non-metallic bulk material, preferably sand, and disposed between the inner layer and the outer layer.

In this case, the use of sand as a bulk material for the intermediate layer is especially expedient. The intermediate layer, in an especially advantageous manner, then performs the function of a heat-insulating layer or course, over the thickness or radial extent of which a reduction in the temperature (temperature gradient) is effected. The intermediate layer absorbs the pressure forces of the inner layer and transmits them. It is therefore both pressure-resistant and temperature-resistant, but has no sealing function. In this case, it is advantageous for the thermal conductivity to be as low as possible, since the thermal conductivity determines the thickness of the insulating layer and the heat flow. At the same time, when sand is used as an intermediate layer, it is essential that this sand, in contrast to a solid material such as a metallic material, for example, achieves relatively good heat insulation and adapts itself especially effectively to conditions, with regard to the requisite shape.

As compared with a ceramic material, which is rigid in the hardened state, or with a castable lightweight refractory concrete, and with masonry, the risk of an incipient crack in the adjacent layers is avoided when using sand as an insulating layer, since no stress concentrations with the sudden appearance of a fracture in the insulating layer can occur in the intermediate layer.

The inner layer of the casing wall, which faces the flow medium and is directly exposed to the latter, merely performs the function of sealing off the pressure space and separates the medium from the further layers. To this end, a small wall thickness in relation to the entire thickness of the wall is required, since this inner layer is supported on the outer layers and only has to transmit the existing internal pressure to the latter. The inner layer is preferably made of a temperature-resistant and extensible material, since this inner layer has to follow the mechanically and thermally induced expansions of the other layers. High-temperature chromium steel or cast steel, preferably 10% chromium steel having a ferritic/bainitic mixed structure, is therefore expediently used as the material for the inner layer.

The outer layer serves to absorb the pressures which are transmitted by the insulating layer of the intermediate layer and which result from the medium pressure and it bears the forces produced by the internal pressure in the turbine casing. The outer layer therefore applies a force opposing the pressure force of the medium. A ferritic/bainitic mixed structure is likewise expediently used as the material for the outer layer.

However, since the load-bearing outer layer has a temperature which is markedly below the medium temperature, due to the inner heat-insulating layer in the form of the intermediate layer composed of a bulk fill, a cost-effective material (spheroidal-graphite cast iron or cast steel) having a comparatively small or low temperature resistance may be used in this case. At the same time, a small wall thickness can be realized, since a comparatively high tolerable stress is present at low temperature. Considerable savings with regard to the material costs which arise are therefore achieved.

In the case of an outer layer composed of two sectional layers, the latter preferably have different coefficients of thermal expansion. The properties of the outer layer can be varied, e.g. with regard to its thermal expansion or the resilience relative to the internal pressure of the turbine casing, through the use of a suitable material pairing like a "bimetal". The stresses on the inner layer due to thermal expansions and the internal pressure can thereby be reduced. An especially flexible adaptation of the rigidity and thermal expansion to the respective application, with regard to an especially low stress on the inner layer, is also possible.

Alternatively, the outer of the two sectional layers may also be composed of or wound from sheet-metal layers, in which case the relatively thin-walled inner sectional layer then merely serves to separate the intermediate layer from the winding layer. In the wound construction, a material reinforced with carbon fibers is preferably used. On the whole, the material concept can be adapted to the respective use determined by the pressure and the temperature of the medium.

Through a suitable selection of the insulating thickness of the intermediate layer and through cooling of the outer layer, their temperature can be specifically set in such a way that, on one hand, low heat losses occur and, on the other hand, the function of the force-transmitting element is ensured. This effect can be intensified by additional cooling of the intermediate layer. The outer layer in turn may be surrounded by heat insulation, which must then have a low insulating effect as compared with previous insulations.

With the objects of the invention in view, there is also provided a method of manufacturing a turbine casing defining an interior space and including a multilayer casing wall having an inner layer sealing off the interior space, a pressure-tight, heat-insulating intermediate layer and a force-transmitting outer layer, which comprises inserting a core representing the intermediate layer into a casting mold while forming a cavity for the outer layer and/or a cavity for the inner layer; and then filling the cavity or cavities with a casting material.

Further cores may be inserted into the casting mold in order to create additional cavities. In particular, pegs distributed over the circumference of the core representing the intermediate layer may also be inserted as additional core support into the casting mold at an end surface of the core. After the casting and removal of the cast pressure casing from the casting mold, these pegs, which are preferably integral parts of the core representing the intermediate layer, are removed. The openings which remain may then be advantageously provided with an internal thread for the screwed connection of a casing cover.

The casing wall may be manufactured in a single-stage or two-stage casting operation. In the single-stage casting operation, a U-shaped hollow profile is created through the use of a number of cores in the casting mold, which is preferably made of a sandy material, and the U-shaped hollow profile is then filled in a single casting operation. In the two-stage casting operation, first of all either the prefabricated inner layer or the prefabricated outer layer, together with the core representing the intermediate layer, is inserted into the casting mold, and then a cavity forming the respective other layer is filled with casting material. In this case, the prefabricated layer may likewise be cast or be formed from solid material.

In an especially advantageous development, the core remains as a heat-insulating intermediate layer in the cast wall component after the casting operation. It is therefore an insulating material at the same time. Through the use of suitable measures relating to the casting, such as, for example, specific cooling or insulation of certain regions, the solidification action can be influenced in such a way that the insulating material is under compressive prestress between the wall layers enclosing it. The intermediate layer is thereby closely integrated in the force flow from the interior space of the casing to the exterior space. The force flow occurs when the outer casing of the turbine is used as prescribed. The insulating material, which remains in the casing component after the casting operation, therefore especially reliably performs the double function of heat insulation and transmission of the operationally induced pressure force prevailing inside the pressure casing, from the inner layer through the intermediate layer to the outer layer.

With the objects of the invention in view, there is additionally provided a method of manufacturing a turbine casing defining an interior space and including a multilayer casing wall having an inner layer sealing off the interior space, a pressure-tight, heat-insulating intermediate layer and a force-transmitting outer layer, which comprises placing a non-metallic bulk material filler, preferably sand, as the intermediate layer in an intermediate space of a U-shaped profile part.

In this further variant, the insulating material forming the intermediate layer is put into an intermediate space formed in the prefabricated wall component of the casing wall and compacted. In this case, the wall component, in one piece or two pieces, may already be composed of the outer layer and the inner layer. In the two-piece construction, the insulating or filling material forming the intermediate layer is put into the intermediate space during the joining of the outer and inner layers. After that, the outer and inner layers may again be cast or be formed from a sheet-metal material.

The advantages achieved with the invention reside, in particular, on one hand in the fact that, through the use of a heat-insulating intermediate layer in the form of a non-metallic, inorganic bulk material, preferably sand, between a comparatively thin-walled inner layer and a correspondingly thin-walled outer layer of a multilayer turbine casing, cracking in the layers as a result of thermal expansions is avoided. At the same time, when sand is used as the intermediate layer, the tasks of heat insulation and mechanical pressure tightness are fulfilled in an especially reliable manner, in which case the sand, in an especially effective manner, as compared with a solidified intermediate or insulating layer, can follow casing deflections caused by thermal stresses. This leads to an especially advantageous behavior of the casing-wall composite formed from the outer layer and the inner layer as well as the intermediate layer. On the other hand, the outer layer, which serves for the application of force, can be kept at an especially low temperature level and can therefore perform its function in a reliable manner. This leads to an especially advantageous behavior of the casing-wall composite formed from the outer layer and the inner layer as well as the intermediate layer.

Due to the division of the wall of the outer casing of a high-pressure turbine into individual layers having particular functions, a considerable reduction in material and thus in costs is achieved as compared with a correspondingly thick-walled casing. In this case, each wall layer can be constructed so as to save material and can be optimized with regard to its function. In order to maintain a minimum pressure on the bulk material, the inner layer and the outer layer are advantageously prestressed to a certain degree, so that the bulk material is present in the compacted state between the outer layer and the inner layer.

Whereas the inner layer is preferably one-piece, the outer layer may be one-piece or may be composed of sectional layers, which then preferably have a different coefficient of thermal expansion. As a result, the expansions to be absorbed by the inner layer are reduced, so that these expansions, in an especially reliable manner, can follow the deformations imposed by the expansion behavior of the composite partners while avoiding the risk of an incipient crack. A further reduction in the temperature level of the outer layer is achieved by cooling of the outer layer.

The turbine casing, which is constructed in the manner described, therefore reliably performs the function of sealing off the trapped medium on one hand and of producing a force opposed to the pressure force of the enclosed medium on the other hand, even at very high temperatures and during operationally induced temperature changes as well as at high steam pressures, and thus at high steam states.

Other features which are considered as characteristic for the invention are set forth in the appended claims.

Although the invention is illustrated and described herein as embodied in a turbine casing and a method of manufacturing a turbine casing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
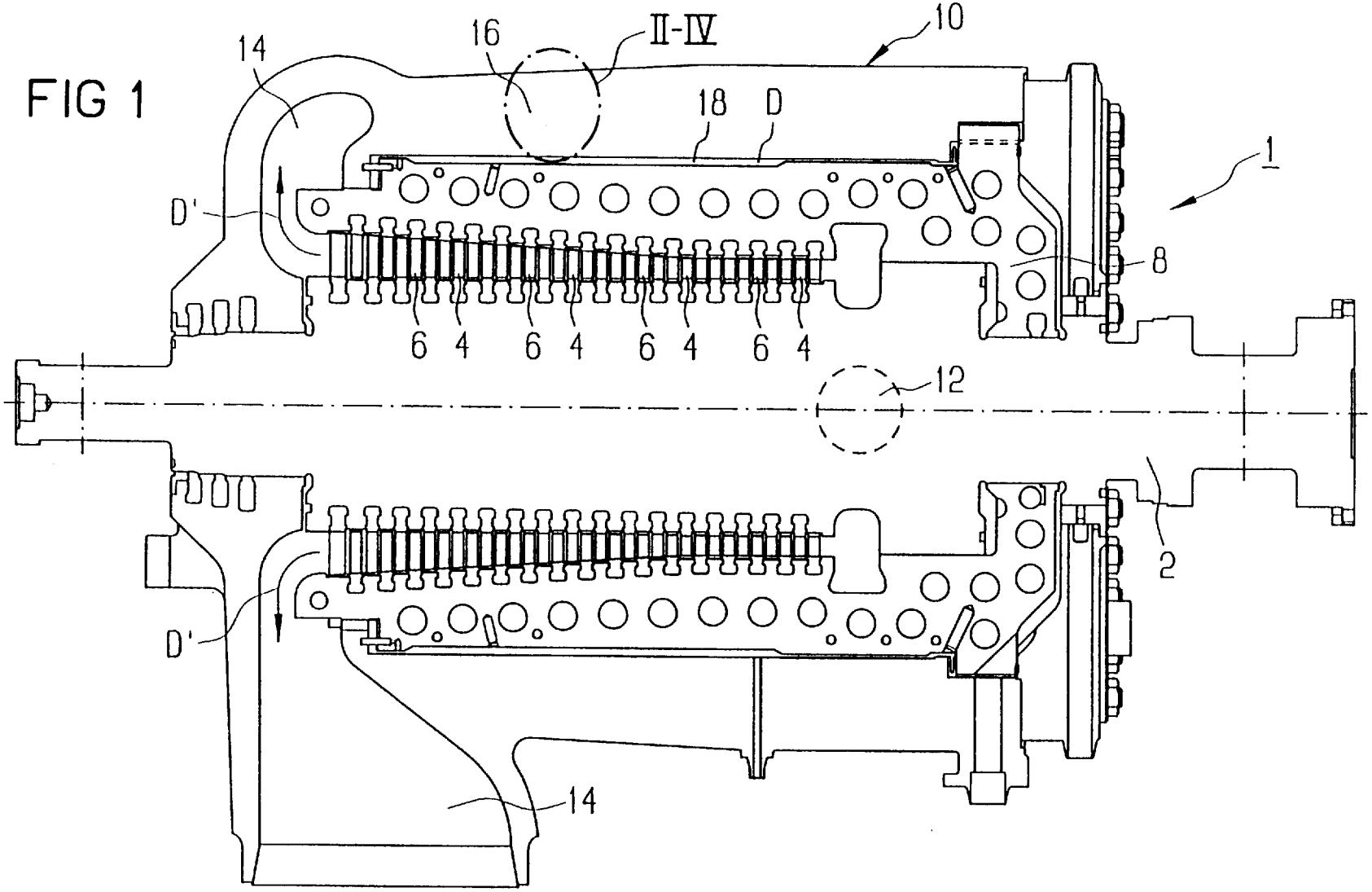
FIG. 1 is a diagrammatic, longitudinal-sectional view of a high-pressure steam turbine having an inner casing and an outer casing shown in a side-elevational view.

Referring now in detail to the figures of the drawings, in which parts corresponding to one another are provided with the same reference numerals, and first, particularly, to FIG. 1 thereof, there is seen a high-pressure steam turbine or high-pressure turbine 1 which includes a turbine shaft 2 with moving blades 4 fastened thereto, an inner casing 8 carrying guide blades 6, as well as an outer casing or pressure casing 10 surrounding the inner casing 8. Live steam D flowing through an inflow port 12 into the high-pressure turbine 1 is passed along the guide and moving blades 4, 6 and expands in the process to perform work, as a result of which the turbine shaft 2 is set in rotational motion. Expanded steam D' leaves the high-pressure turbine through an outflow port 14, for example to a non-illustrated intermediate-pressure turbine section. In the exemplary embodiment, the live steam D, at a steam temperature T of, for example, 600° C. and a steam pressure p of, for example, 300 bar, is admitted to a pressure space 18 formed between the inner casing 8 and the pressure casing 10.

Figure 2:
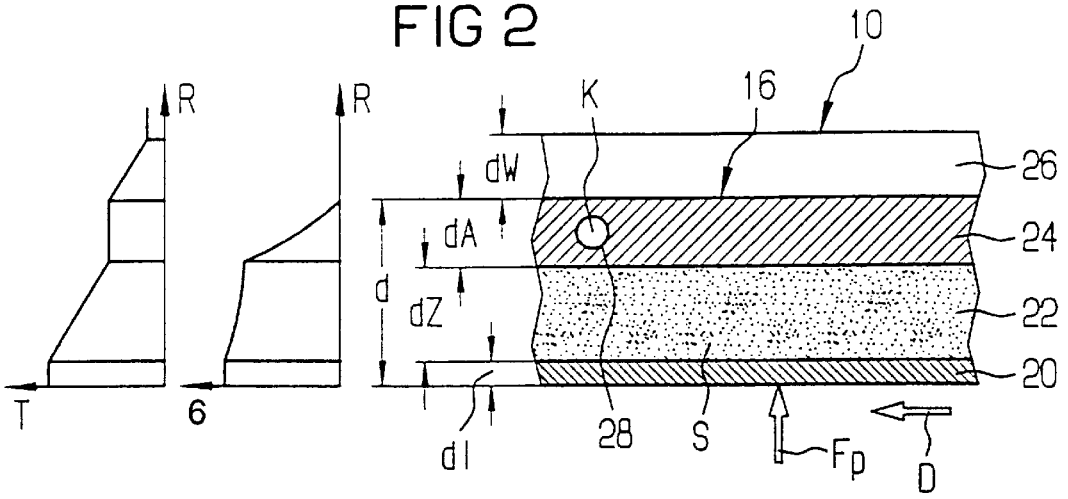
FIGS. 2 to 4 are respective fragmentary, sectional views of portions II, III and IV of the outer casing according to FIG. 1 with alternative variants of a multilayer casing wall.

FIG. 2 shows a first variant of a multilayer structure of a wall 16 of the outer or pressure casing 10 of the high-pressure turbine 1. The casing wall 16 includes an inner layer 20 directly exposed to the live steam D. The inner layer 20 is temperature-resistant and is made, for example, of high-temperature steel. The inner layer 20 serves to seal the pressure space 18 formed between the inner casing 8 and the pressure casing 10 of the high-pressure steam turbine and separates the steam D from the following layers of the casing wall 16. A layer thickness dI of the inner layer 20, i.e. its extent in a radial direction R, is small as compared with a total thickness d of the casing wall 16. Since the inner layer 20 transmits the pressure p, acting on it, of the steam D, i.e. a pressure force $F_p$ of the latter, to the further layers, the material used must merely have as high an extensibility and as high a temperature resistance as possible.

Adjoining the inner layer 20 is an intermediate layer 22 for heat insulation, which is made in the form of a bulk material. To this end, sand S is expediently used as the bulk material. As a result, the intermediate layer 22 is pressure-resistant or pressure-tight, so that an incompressible insulating course is formed. On one hand, the temperature T is reduced over a thickness dZ of the intermediate layer 22, as is illustrated with reference to a left-hand temperature diagram in FIG. 2 along an extension in the radial direction R of the casing wall 16. On the other hand, the intermediate layer 22 serves to absorb the pressure force $F_p$ of the steam D and to transmit the pressure force $F_p$ acting on the inner layer 20 to an outer layer 24.

The outer layer 24 is preferably made of ferritic/bainitic steel, e.g. of chromium steel, in the same way as the inner layer 20. The outer layer 24 forms a force-transmitting element of the entire composite of the casing wall 16 and absorbs pressures transmitted by the intermediate layer 22 resulting from the steam pressure p in the pressure space 18. It therefore bears the pressure force $F_p$ produced by the internal pressure between the inner casing 8 and the pressure or outer casing 10. The temperature to be coped with by the outer layer 24, as is illustrated in the left-hand diagram of FIG. 2, is substantially lower than the temperature T of the steam D due to the temperature gradient in the radial direction R along the intermediate layer 22.

The material used for the outer layer 24, e.g. grey cast iron, may have a low temperature resistance as compared with the inner layer 20. In this case, a wall thickness or layer thickness dA which is small as compared with the intermediate layer 22 can also be realized at the same time. A basic radial-stress profile σ is illustrated in the right-hand diagram of FIG. 2.

A heat-insulating layer 26 which encloses the outer layer 24 and thus the entire composite of the casing wall 16 may be provided for additional heat insulation. Furthermore, in order to cool the outer layer 24, it may be provided with a cooling-passage system 28, to which a cooling medium K, for example steam D' that has already expanded, is admitted. Alternatively or additionally, the cooling-passage system 28 may also be provided in the intermediate layer 22 or may lie on the outside of the outer layer 24. Due to a thickness dW of the heat-insulating layer 26 and due to the additional cooling of the outer layer 24 and/or of the intermediate layer 22, the temperature of the outer layer 24 and/or of the intermediate layer 22 can be specifically set in such a way that, on one hand, low heat losses occur over the casing wall 16 and, on the other hand, the force-transmitting function is further improved.

Figure 3:
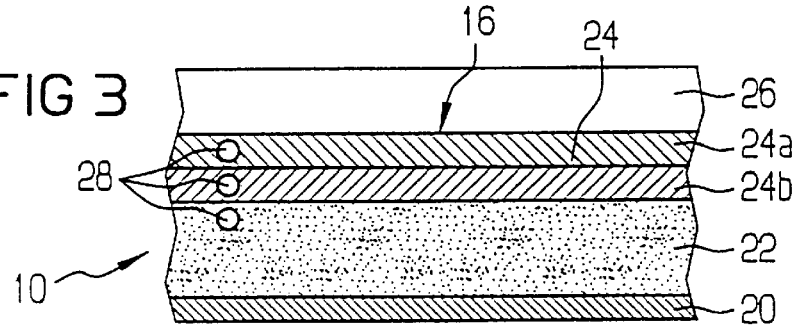

FIG. 3 shows a further variant having an outer layer 24 composed of two sectional layers 24*a* and 24*b*. The two sectional layers 24*a* and 24*b* are made of materials having different coefficients of thermal expansion (material pairing). As a result, an especially flexible adaptation to different applications with simultaneous reduction in the stress on the inner layer 20 and sufficient rigidity as well as adequate thermal expansion of the entire composite of the casing wall 16 is possible.

Figure 4:
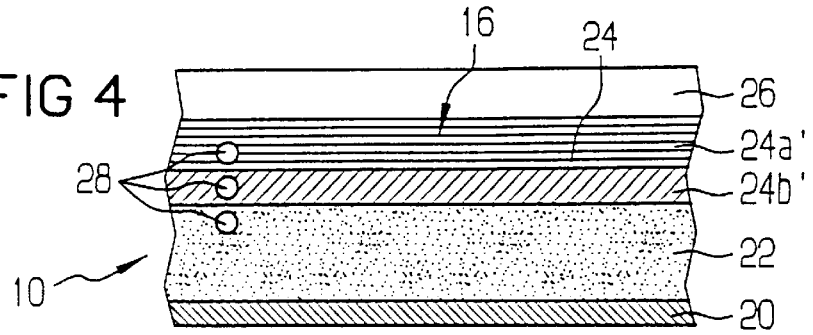

Furthermore, FIG. 4 shows a variant in which the outer layer 24 is again made of a first sectional layer 24*a'* and a second sectional layer 24*b'*. In this case, the outer, first sectional layer 24*a'* has a wound construction, in which a material reinforced with carbon fibers is preferably used. The inner, second sectional layer 24*b'* merely serves to separate the intermediate layer 22 and the wound sectional layer 24*a'* or the sectional layer 24*a'* provided with tension-element layers and may therefore have an appropriate thin-walled construction. The sectional layer 24*a'* may also be wound or constructed from steel layers (sheet-metal layers).

Figure 5:
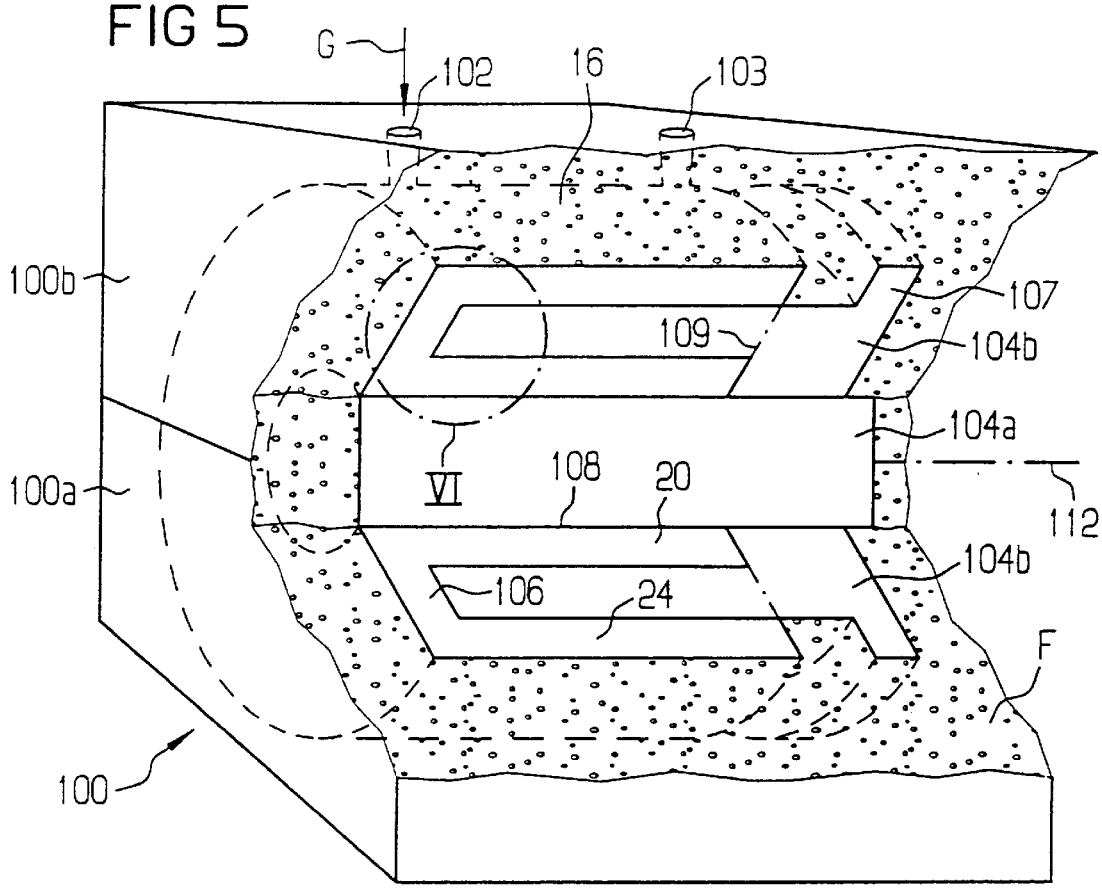
FIG. 5 is a partly broken-away, perspective view of a multilayer casing section in a casting mold having a plurality of cores.

FIG. 5 shows a casting mold 100 having a feed opening (feeder) 102 and a rise opening (riser) 103 as well as a number of cores 104*a,* 104*b* for casting the multilayer cylindrical casing wall 16 and thus for manufacturing the outer or pressure casing 10 of the steam turbine 1. The casting mold 100 forms a rotationally symmetrical and U-shaped hollow profile 106 in combination with the configuration of the cores 104*a,* 104*b* as shown. The hollow profile 106 has an outer cavity or cavity leg for the subsequent outer layer 24 and an inner cavity leg for the subsequent inner layer 20 of the casing wall 16.

The hollow profile 106, which is to be filled with a casting material G, is produced through the use of a pattern representing the casing wall 16, in the expendable casting mold 100 of fine-grained molding material F. To this end, a bottom box 100*a* and then a top box 100*b,* are rammed up on the pattern as molding boxes of the casting mold 100. In the process, the mineral molding material F, which contains mineral constituents provided with bonding agents, is consolidated. After the pattern has been lifted out of the molding boxes 100*a,* 100*b,* the cores 104*a,* 104*b* are inserted into the casting mold 100. In this case, the cores 104*a,* 104*b* can be reinforced in the longitudinal and circumferential directions through the use of core bars. After the casting mold 100 has been closed by assembling the molding boxes 100*a,* 100*b,* the casting material G is poured into the hollow profile 106 through the feed opening 102, in the course of which the casting material G which has passed into the riser 103 can flow back into the hollow profile 106. In this case, an encircling collar 107 on the core 104*b* serves to absorb forces and moments which may occur due to the core weight or as a result of core lift during the casting operation.

After the casting material G has solidified, the casting mold 100 is removed from the cast casing wall 16. The central core 104*a*, which represents an interior space 108 of the casing, and partially the annular intermediate core 104*b*, are then removed. That part of the core 104*b* which lies between the outer layer 24 and the inner layer 20 of the casing wall 16 remains in the cast component as the intermediate layer 22 seen in FIG. 6. Therefore, at the same time, this part, which is separated from the core 104*b* along a broken parting line 109, is advantageously an insulating material inside the casing wall 16. On one hand, a manufacturing stage with regard to the realization of the intermediate layers 22 is thereby saved. On the other hand, the corresponding part of the core 104*b*, during the solidification action of the casting material G, is embedded in a form-locking and force-locking manner as the intermediate layer 22 inside the hollow profile 106 between the outer layer 24 and the inner layer 20 of the casing wall 16. A form-locking connection is one which connects two elements together due to the shape of the elements themselves, as opposed to a force-locking connection, which locks the elements together by force external to the elements.

Figure 6:
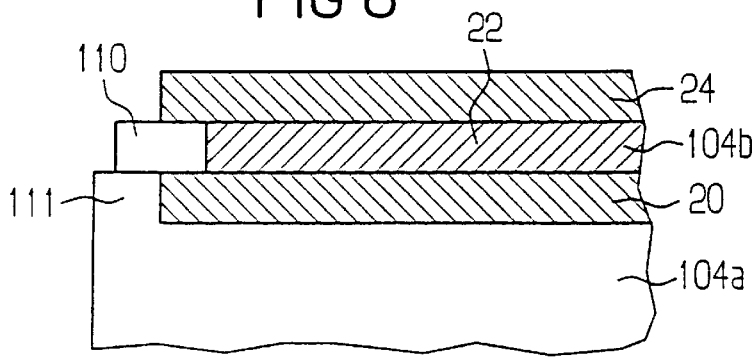
FIG. 6 is a longitudinal-sectional view of a portion VI of FIG. 5 having an additional core support.

FIG. 6 shows a portion of a preferred additional core support in an apex region VI of the hollow profile 106. In this case, a plurality of pegs 110, e.g. four pegs 110, are distributed over the circumference. These pegs 110, which project over part of their length into an intermediate space between the outer layer 24 and the inner layer 20, rest on a collar 111 provided on the core 104*a*, e.g. in recesses provided therein. These pegs 110 are preferably an integral part of the core 104*b*. The pegs 110 are removed after the casting operation. Appropriate threads for screwing on a casing cover can then be made in openings which are produced, and the casing cover is then tightly welded.

Each wall layer 20 to 24 can be constructed so as to save material and in the process can be optimized in its function by the division of the casing wall 16, i.e. the wall of the pressure casing 10, into functional carriers which are separate from one another. Since the inner layer 20 is supported on the intermediate layer 22 and through the latter on the outer layer 24 and only has to transmit the existing internal pressure to the outer layer 24, a small wall thickness of the inner layer 20 in relation to the entire thickness of the wall is required. A 9% to 11% chromium steel, in particular a 10% chromium steel, having a ferritic/bainitic mixed structure, is preferably used as the casting material.

Figure 7:
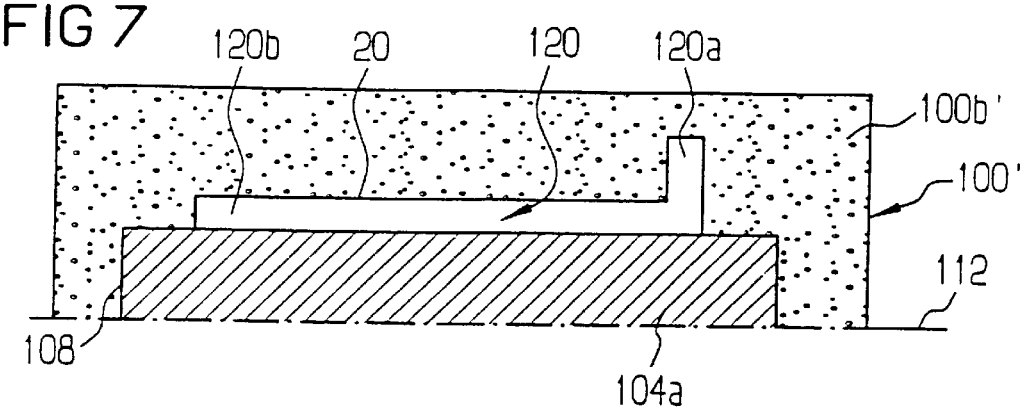
FIGS. 7 to 9 are longitudinal-sectional views of casting molds for a stage-by-stage manufacture of a multilayer casing section.

FIG. 7 is a simplified representation showing that part of a casting mold 100' which lies above a line of symmetry or axis of rotation 112 in a similar manner to FIG. 5, namely a casting mold 100' representing a top molding box 100*b'*. That part of the core 104*a*, again filling the subsequent interior space 108 of the casing, which lies above the axis of rotation 112, defines an L-shaped hollow profile 120 having legs 120*a* and 120*b* which have been modeled in the casting mold 100', that is again made of fine-grained molding material F. In this variant, first of all the inner layer 20 is made by filling the hollow profile or cavity 120 through the use of the casting material G.

Figure 8:
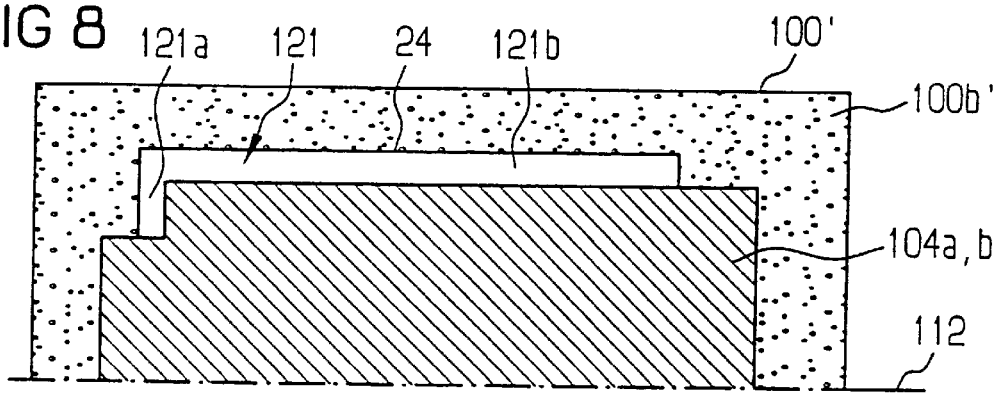

Alternatively, as FIG. 8 shows, first of all the outer layer 24 can be made in a similar manner. In this case, the casting mold 100' differs from the alternative according to FIG. 7 essentially by the radial extent of the core 104*a*, 104*b*. The latter represents the subsequent casing interior space 108 as well as the space required for the inner layer 20 and the intermediate layer 22. A cavity 121 which is preferably provided for producing the outer layer 24 again has an L-shaped profile with a short leg 121*a* and a long leg 121*b*. In contrast to the cavity 120 provided for the inner layer 20, the short leg 121*a* is disposed on the side opposite the short leg 120*a* of the inner layer 20 and is oriented towards the axis of rotation 112.

Figure 9:
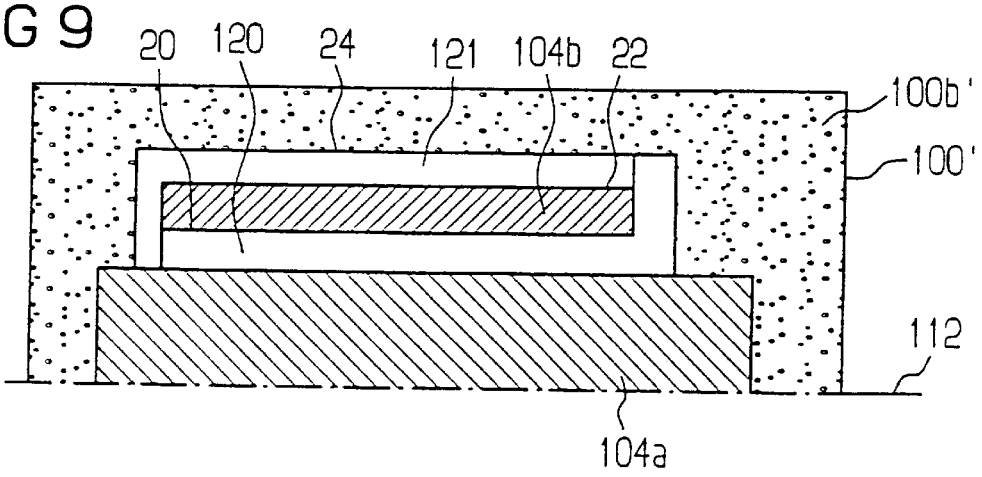

FIG. 9 shows the manufacture of the multilayer casing wall 16 in a further manufacturing stage in which, together with the core 104*a* representing the interior space 108 of the casing, either the inner layer 20 which is prefabricated in the first manufacturing stage according to the alternative of FIG. 7, or the outer layer 24 that is prefabricated according to the alternative of FIG. 8, is inserted into the corresponding casting mold 100'. At the same time, the core 104*b* representing the intermediate layer 22 is inserted into the casting mold 100' that is appropriately modeled beforehand. In this case, depending on the alternative, the cavity 120 for the inner layer 20 or the cavity 121 for the outer layer 24 is formed. This respective cavity 120 or 121 is then filled with casting material. In the case of the casing wall 16 which is manufactured in this way, the core 104*b* also remains as the intermediate layer 22 in the cast component.

Instead of the insertion of a separate core 104*b*, the insulating material can also be applied in the required wall thickness and with the required shaping to the already prefabricated layer 24, 20. In this case, the insulating material should be applied and if need be reinforced in such a way that it meets the requirements of the further casting process. In order to reinforce the insulating material, core bars, for example, may be used. The shaping of the insulating material may also be carried out by specific core shapes, into which the layer 24, 20 that was already made or prefabricated is inserted and shaped with insulating material. The casting which is shaped in this way with insulating material and inserted into the casting mold 100' then again virtually forms a core that already contains one of the layers 24, 20 of the subsequent casing wall 10 and remains in the completed component after the further casting operation.

The cast parts or layers 24, 20 which are produced one after the other are reliably joined at the contact surfaces of the legs 120*a* and 121*b* as well as 120*b* and 121*a*, respectively, by a form-locking connection, a force-locking connection, an integral or material-locking connection or a combination of these types of connections. A joint may also be made subsequently, for example by welding. Due to the casting sequence, desired compressive prestressing of the insulating material between the surrounding wall parts or wall layers 24, 22 can be achieved as a result of shrinkage. This effect can be assisted by appropriate measures relating to the casting, for example by specific cooling.

On one hand, an essential advantage of the stage-by-stage manufacture of the casing wall 16, as compared with the manufacture in one stage in the exemplary embodiment according to FIG. 5, lies in the ease with which various materials can be combined in accordance with the various demands made on the inner layer 20 and on the outer layer 24, respectively. A further advantage resides in the comparatively simple configuration of the casting mold 100' to be prepared in each case. On the other hand, the essential advantage of the method of manufacture in the exemplary embodiment according to FIG. 5 lies in the fact that only the one casting step is required.

Figure 10:
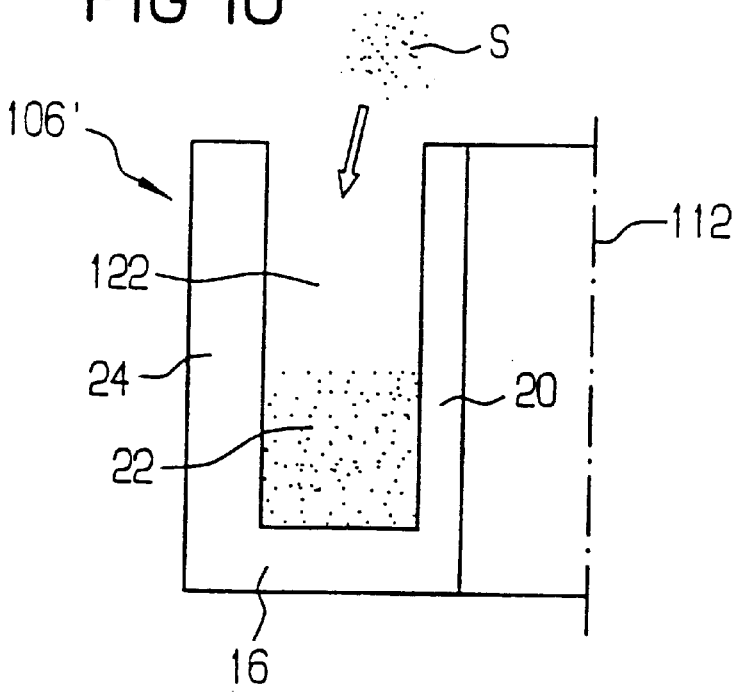
FIGS. 10 and 11 are longitudinal-sectional views showing a placement of an intermediate layer in a double-walled, one-piece or multi-piece casing-wall section.
Figure 11:
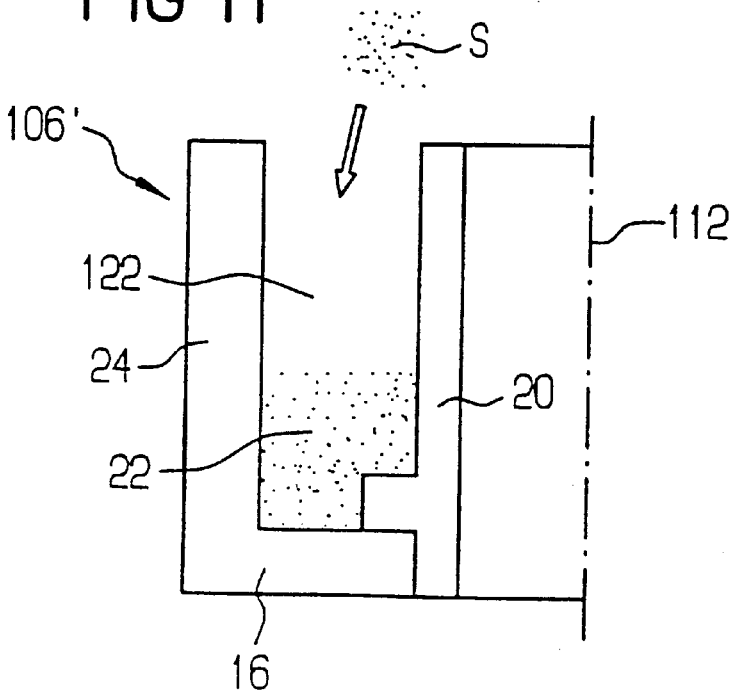

In an alternative method of manufacture according to FIGS. 10 and 11, first of all a U-shaped profile part 106' is made as a casing wall 16 according to one of the so-called metal-forming, joining or cutting or metal-removing production processes. Additionally, in the variant according to FIG. 10, first of all a cylindrical casing wall 16 for producing the U-shaped profile part 106' having a leg representing the inner layer 20 and a leg representing the outer layer 24 can again be cast. The annular intermediate space 122 which remains between the legs of the U-shaped profile part 106' for forming the intermediate layer 22 is then filled with sand S as an insulating material and the latter is compacted.

The method of manufacture illustrated with reference to FIG. 11 is especially suitable as a combination of a low-melting-point material, e.g. spheroidal-graphite cast iron for the outer layer 24, and a high-melting-point material, e.g. ferrite or austenite for the inner layer 20, in the same way as the method of manufacture described with reference to FIGS. 7 to 9. In this case, the two layers 24 and 20 become separate, e.g. they are made by a metal-forming production process and are then assembled together to form the U-shaped profile part 106'. The profiles of the outer layer 24 and the inner layer 20 which are assembled in the process may be different.

In this case, FIG. 11 shows a possible construction of a profile in which the outer layer 24 is again L-shaped, whereas the inner layer 20 has a step contour adapted thereto. In this alternative, the insulating material is fed in the form of the bulk material S into the intermediate space 122 as the intermediate layer 22 during the joining of the two layers 24 and 20 and is then compacted.

With the sand S again being expediently poured in as a filler for the intermediate layer 22, relatively good heat insulation is achieved, in contrast with a solid material such as, for example, a metallic material. The sand S adapts itself especially well to the conditions, with regard to the required shape. The risk of a fracture with an incipient crack in the adjacent layers 24, 20 as a result of a stress concentration caused by the fracture is therefore advantageously avoided. The sand S should be present in the compacted state between the outer layer 24 and the inner layer 20. The inner layer 20 and the outer layer 24 are prestressed in order to maintain a minimum pressure on the sand S.

We claim:

1. In a turbine casing defining a pressure space, the improvement comprising:

a multilayer casing wall having an inner layer sealing off the pressure space, a force-transmitting outer layer, and a pressure-tight, heat-insulating intermediate layer formed of non-metallic bulk material and disposed between said inner layer and said outer layer.

2. The turbine casing according to claim 1, wherein said bulk material is sand.

3. The turbine casing according to claim 1, wherein said intermediate layer is thicker than said inner layer and said outer layer.

4. The turbine casing according to claim 1, wherein at least one of said inner and outer layers is formed of high-temperature metal.

5. The turbine casing according to claim 1, wherein said high-temperature metal is 10% chromium steel.

6. The turbine casing according to claim 1, wherein said outer layer is formed of at least two sectional layers having different thermal expansion properties.

7. The turbine casing according to claim 6, wherein one of said at least two sectional layers is a wound outer sectional layer.

8. The turbine casing according to claim 1, including an insulating layer at least partly enclosing said outer layer.

9. The turbine casing according to claim 1, including a system for cooling at least one of said outer and intermediate layers.

10. In an outer casing of a high-pressure turbine defining a pressure space, the improvement comprising:

a multilayer casing wall having an inner layer sealing off the pressure space, a force-transmitting outer layer, and a pressure-tight, heat-insulating intermediate layer formed of non-metallic bulk material and disposed between said inner layer and said outer layer.

11. The turbine casing according to claim 10, wherein said bulk material is sand.

12. In a method of manufacturing a turbine casing defining an interior space and including a multilayer casing wall having an inner layer sealing off the interior space, a pressure-tight, heat-insulating intermediate layer and a force-transmitting outer layer, the improvement which comprises:

inserting a core representing the intermediate layer into a casting mold while forming at least one cavity for at least one of the outer layer and the inner layer; and then filling the at least one cavity with a casting material.

13. The method according to claim 12, which comprises forming a U-shaped hollow profile for the inner layer and for the outer layer inside the casting mold with the core representing the intermediate layer and another core forming the interior space.

14. The method according to claim 12, which comprises inserting the inner layer in a prefabricated state and the core representing the intermediate layer into the casting mold, and filling the cavity for the outer layer.

15. The method according to claim 12, which comprises inserting the outer layer in a prefabricated state and the core representing the intermediate layer into the casting mold, and filling the cavity for the inner layer.

16. The method according to claim 14, which comprises forming the at least one cavity for at least one of the outer layer and the inner layer as an L-shaped cavity in the casting mold.

17. The method according to claim 15, which comprises forming the at least one cavity for at least one of the outer layer and the inner layer as an L-shaped cavity in the casting mold.

18. The method according to claim 12, wherein the core representing the intermediate layer remains as the intermediate layer in the casing wall.

19. The method according to claim 12, which comprises inserting a number of pegs into the casting mold for core support, together with the core representing the intermediate layer.

20. In a method of manufacturing a turbine casing defining an interior space and including a multilayer casing wall having an inner layer sealing off the interior space, a pressure-tight, heat-insulating intermediate layer and a force-transmitting outer layer, the improvement which comprises:

placing a non-metallic bulk material filler as the intermediate layer in an intermediate space of a U-shaped profile part.

21. The method according to claim 20, which comprises using sand as the bulk material filler.

22. The method according to claim 20, which comprises forming the U-shaped profile part as a multi-part profile part, and introducing the filler as the intermediate layer during joining of the outer layer and the inner layer.

23. The method according to claim 20, which comprises forming the U-shaped profile part as a multi-part profile part, and introducing the filler as the intermediate layer after joining of the outer layer and the inner layer.

24. The method according to claim 20, which comprises casting at least one of the outer layer and the inner layer from high-temperature metal.

25. The method according to claim 20, which comprises casting at least one of the outer layer and the inner layer from 9% to 11% chromium steel.

* * * * *